United States Patent [19]

Knight

[11] 4,226,329

[45] Oct. 7, 1980

[54] SANDING DISC CONTAINER

[76] Inventor: David Knight, 1263 S. 9th St., South Plainfield, N.J. 07080

[21] Appl. No.: 46,464

[22] Filed: Jun. 7, 1979

[51] Int. Cl.[3] ..... B65D 83/08; B65D 85/62

[52] U.S. Cl. ..... 206/372; 206/445; 211/49 R

[58] Field of Search ..... 206/372, 445, 37; 211/49 R, 40; 248/506, 346; 312/42, 45; 220/3.3, 18

[56] References Cited

U.S. PATENT DOCUMENTS

| | | | |
|---|---|---|---|
| 1,086,409 | 2/1914 | Smith | 206/372 |
| 1,367,948 | 2/1921 | Curtin | 211/49 R |
| 1,380,041 | 5/1921 | Cook | 248/506 |
| 1,658,085 | 2/1928 | Hudson | 211/49 R |
| 2,437,956 | 3/1948 | Hessel | 206/37 |
| 3,197,548 | 7/1965 | Weiteman et al. | 220/3.3 |
| 3,393,798 | 7/1968 | Beers | 206/372 |

*Primary Examiner*—William T. Dixson, Jr.
*Attorney, Agent, or Firm*—Carella, Bain, Gilfillan & Rhodes

[57] ABSTRACT

A sanding disc container is disclosed to include a generally cylindrical member substantially closed at one end and having a longitudinally extending opening through a portion of the length of one wall of the cylinder. Sanding discs are disposed within the cylindrical member having their abrasive sides facing the closed end of the cylinder to provide access to the wheel of a sanding machine through the open end of the cylinder.

4 Claims, 3 Drawing Figures

SANDING DISC CONTAINER

BACKGROUND OF THE INVENTION

This invention relates to auxilliary equipment for sanding apparatus.

More specifically, this invention relates to a dispensing container for sanding discs which eliminates the major source of wastage of such sanding discs presently experienced in the field.

A typical sanding disc comprises a piece of relatively heavy paper cut in circular form and having an abrasive material broadcast on one side thereof. The other side is sometimes provided with an adhesive for securing the disc to a sanding wheel. Other types rely on adhesive or other securing means associated with the sanding wheel to hold the disc in position during operation.

During the use of sanding discs, particularly in finishing type operations or preparatory operations where ultimate surface finish is a primary consideration, it is generally recognized in the field that the sanding disc must be free of all foreign matter. Thus, if a disc falls to the floor of a paint shop, it is ordinarily required that the disc be discarded because of the likelihood of the occurrence of a foreign object adhering to the abrasive surface of the disc. Such a foreign object would be likely to cause a gouge in the surface being finished and as such the risk of this occurrence makes it necessary that the disc be discarded.

As also will be recognized by those skilled in these arts, it is not unusual for sanding discs to be dropped. It is a typical occurrence in most finishing shops, paint shops and the like to have a pile of sanding discs stored adjacent a mechanic's operating area so that the mechanic may be relatively easy access thereto. It is, thus, often the case that sanding discs are knocked to the floor, blown over by a puff of air or otherwise dropped with a degree of regularity which makes the situation quite expensive. In this regard, I have found that wastage of sanding discs prior to my development of the present invention amounted to approximately fifteen (15) to twenty (20) percent of the total number of discs purchased. In a manufacturing or other type operation which does a significant amount of sanding, this obviously constitutes a major source of lost income.

The present invention, although extremely uncomplicated and straight forward in both structure and approach, has substantially eliminated wastage of sanding discs by reason of droppage. It is simple, inexpensive, easy to use and extremely effective.

SUMMARY OF THE INVENTION

It is an object of the present invention, therefore, to provide a means for reducing or substantially eliminating wastage of circular articles such as sanding discs by reason of their being contaminated through inadvertent contact with dirty surfaces.

Another object of the present invention is to provide a storage and dispensng means for sanding discs which retains such discs in a protected structure prior to use.

Still a further object of the present invention is to provide a container for sanding discs which is capable of being utilized in multiple units so as to provide ready access to a plurality of sanding discs of different abrasive characteristics in a position which is easily accessible to an operator.

These objects and others not enumerated are achieved by the apparatus of the present invention, one embodiment of which may include a cylindrical member having a generally cylindrical outer wall, a first end opening and a second end opening, a base member substantially closing the second opening in the cylindrical member, and a slot formed in the cylindrical wall, the slot being formed to extend longitudinally from the first opening through a portion of the length of the cylindrical member toward the base.

BRIEF DESCRIPTION OF THE DRAWINGS

A more complete understanding of the present invention may be had from the following detailed description particularly when read in the light of the accompanying drawings wherein.

DETAILED DESCRIPTION OF THE INVENTION

Figure 1:
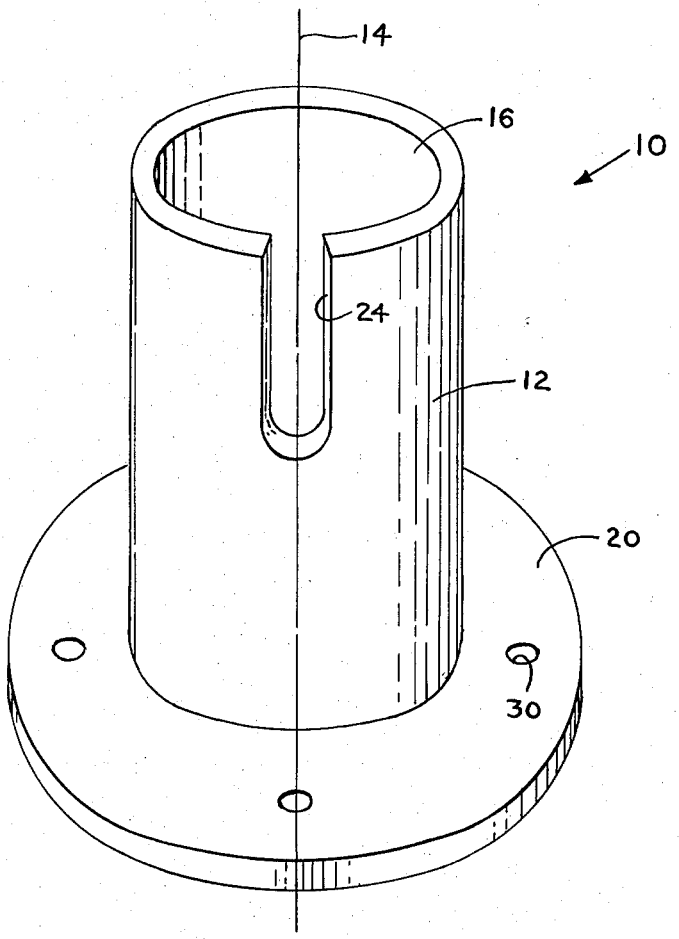
FIG. 1 is a perspective view of sanding disc dispenser according to the present invention.
Figure 2:
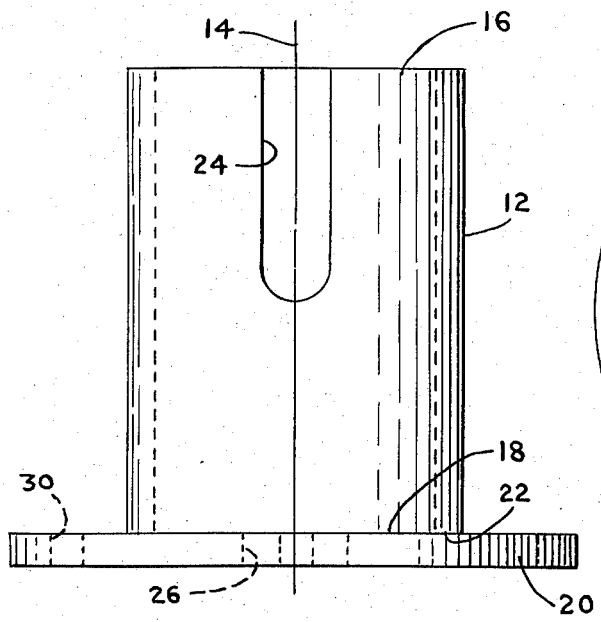
FIG. 2 is a front elevational view of sanding disc dispenser according to the invention.
Figure 3:
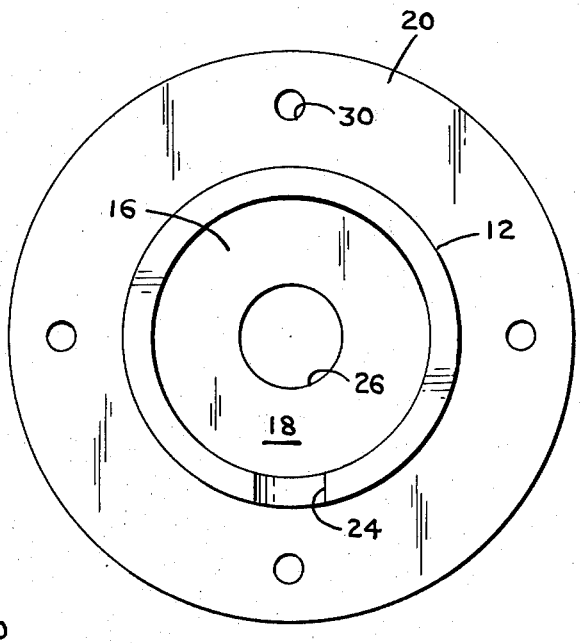
FIG. 3 is a top view of sanding disc dispenser according to the invention.

Referring therefore to FIG. 1, a sanding disc dispenser according to the present invention is shown and designated generally by the reference numeral 10.

Dispenser 10 comprises a generally cylindrical member 12 the center of which is defined by longitudinally extending access 14.

Cylindrical member 12 is provided with an open end 16 and a closed end 18. In this regard, closed end 18 is closed by a generally circularly shaped base member 20 which is suitably secured to the lower edge 22 of cylindrical member 12.

Formed in cylindrical member 12 is a slot 24 which extends generally longitudinally through a portion of the length of cylindrical member 12. Slot 24 is dimensioned to accommodate the passage therein of a portion of a sanding apparatus such as to permit the introduction of a sanding wheel into the interior of cylindrical member 12 such as to be able to contact a sanding disc stored therein. Thus, sanding discs may be stored one upon the other within cylindrical member 12 and, as discs must be replaced, the sanding wheel of the sander can be moved downwardly within the cylindrical member until its adhesed surface comes into contact with the smooth or back surface of the sanding disc. A firm mating engagement can be achieved by pressing the sanding wheel against the sanding disc and thus, when the sanding wheel and disc thereon are removed from the dispenser 10 the sanding disc is in position to be utilized.

Formed axially centrally of base member 20 is a throughbore 26. Throughbore 26 permits an operator to force sanding discs upwardly out of cylindrical member 12 in the event that there is any clogging or the like.

It will be recognized by those skilled in these arts that cylindrical member 12 may be provided in a plurality of diameters to accommodate sanding discs of various diameters. Further, it is within the contemplation of the present proposal that a plurality of dispensers 10 may be provided on a supporting surface, possibly a movable support means such a cart to store sanding discs of different grit levels whereby to provide a complete inventory of sanding discs for use by a mechanic throughout the entire course of a finishing job.

Dispensers 10 may be secured to support structures in a number of manners. Thus, the under surface of base 20 may be provided with an adhesive such as to permit the dispenser 10 to be adhesively secured to a support structure. Alternatively, suitable bores such as bores 30 may be provided to permit the passage therethrough of screws or bolts so as to affix a dispenser 10 to a supporting surface.

Sanding disc containers according to the present invention may be manufactured from any of many materials which are generally known to those skilled in these arts. Thus, they may be manufactured from appropriate sheet metal, plastics, wood or composition material such as heavy cardboards and the like. They may be manufactured using techniques well-known to those having skill in the arts, may be done so very inexpensively.

Although the present invention is fundamentally simple in its construction, the economies achieved through its use are astounding. As noted above, the present invention has permitted the elimination of 15% to 20% wastage in the utilization of sanding discs in a typical paint shop operation. Thus, although simple, the present invention constitutes a significant step forward in the arts. In this regard, it will be recognized by those skilled in these arts that many modifications and variations to the preferred embodiment described in detail above may be made without departing from the spirit and scope of the present invention.

I claim:

1. Container means for holding abrasive discs comprising:

a cylindrical member, said cylindrical member having a generally cylindrical outer wall, a first end opening and a second end opening;

a base member substantially closing said second opening in said cylindrical member;

slot means formed in said cylindrical wall, said slot means being formed in said wall to extend longitudinally from said first opening end through a portion of the length of said cylindrical member; and a throughbore formed in said base member to permit access to the interior of said cylindrical member from and through the base member.

2. Apparatus according to claim 1 wherein said base member extends beyond the surface of said cylindrical member in a plane normal to the longitudinal axis of said cylindrical.

3. Apparatus according to claim 2 including means disposed on said base member for securing said apparatus to a surface.

4. Apparatus according to claim 3 including at least a second cylindrical member, the longitudinal axis of said second cylindrical member being disposed substantially parallel to the longitudinal axis of said first cylindrical member, said second cylindrical member having a first end opening and a second end opening, said second end opening of said second cylindrical member being closed by said base member; and said second cylindrical member having a slot disposed in the cylindrical wall thereof, said slot extending from said first opening of said second cylindrical member throughout a portion of the length of said cylindrical wall of said second cylindrical member.

* * * * *